United States Patent [19]

Verhoeven et al.

[11] 4,198,587

[45] Apr. 15, 1980

[54] COLOR CRT SHIELDING CONE HAVING FOUR METAL PLATES EXTENDING FROM CORNERS OF SMALLER APERTURE TO WALL COATING

[75] Inventors: Martinus C. M. Verhoeven; Andrianus M. Kersten; Giovanni Serio, all of Eindhoven, Netherlands

[73] Assignee: U.S. Philips Corporation, New York, N.Y.

[21] Appl. No.: 953,326

[22] Filed: Oct. 20, 1978

[30] Foreign Application Priority Data

Nov. 15, 1977 [NL] Netherlands ..... 7712535

[51] Int. Cl.[2] ..... H01J 29/07; H01J 31/20

[52] U.S. Cl. ..... 313/402

[58] Field of Search ..... 313/402, 408, 403, 407

[56] References Cited

U.S. PATENT DOCUMENTS 4,002,941 1/1977 Demmy ..... 313/402

FOREIGN PATENT DOCUMENTS 2000675 1/1970 Fed. Rep. of Germany ..... 313/402

1762029 11/1970 Fed. Rep. of Germany ..... 313/402

*Primary Examiner*—Robert Segal

*Attorney, Agent, or Firm*—Algy Tamoshunas

[57] ABSTRACT

A color display tube having a magnetic screening cap provided with four resilient metal plates extending radially in the direction of the corner points of the display screen at the edge of the end of the cap having the smallest diameter. The plates press against the electrically conductive inner coating of the cone and which would otherwise prevent electrons pass between the screening cap and the conductive inner coating of the cone from impinging upon the display screen.

3 Claims, 5 Drawing Figures

Figure 1:
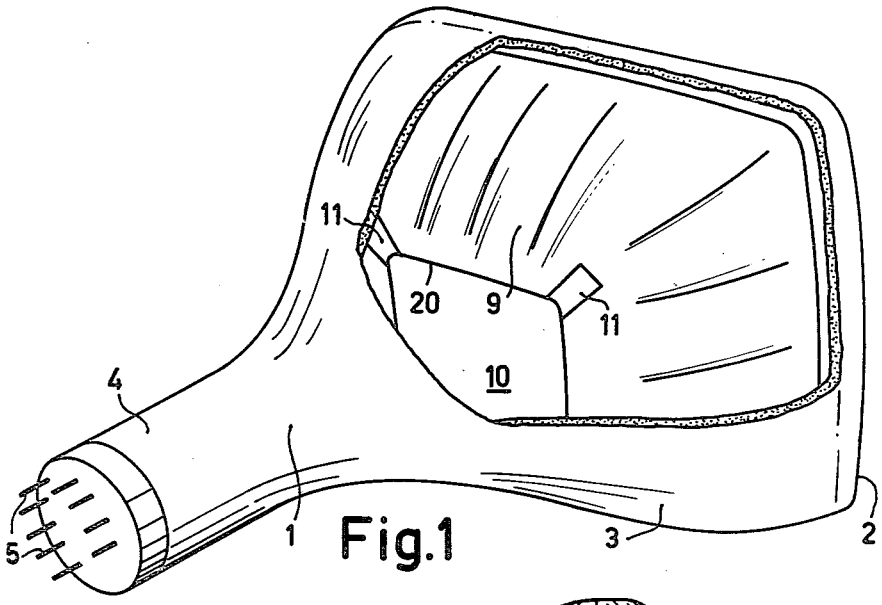

COLOR CRT SHIELDING CONE HAVING FOUR METAL PLATES EXTENDING FROM CORNERS OF SMALLER APERTURE TO WALL COATING

The invention relates to a colour display tube comprising, in an envelope having a rectangular display window, a cone with an electrically conductive inner coating and a neck, a display screen on the inside of the display window, a colour selection electrode at some distance in front of the display screen, means to generate at least one electron beam in the neck and a magnetic screening cap which extends in the cone from the colour selection electrode.

Such a colour display tube is known from the German Patent Application No. 2,000,675 laid open to public inspection. In an embodiment described in said Patent Application a screening ring is provided which extends radially outwards at the wide end of the magnetic screening cap and intercepts the electrons passing between the screening cap and the cone towards the display screen. As a result of the tolerances in the dimensions of the screening ring and the cone, there remains a slot between the screening ring and the cone, particularly in the corners of the display screen, through which electrons may nevertheless pass, which results in a disturbing lighting up of the display screen, in particular in the corners.

In German Patent Specification 1,762,029 a screening ring consisting of a piece of rolled aluminium foil is provided between the edge of the colour selection electrode and the upright edge of the display window. Such screening presents problems in particular in the corners and is cumbersome and expensive. Because such a foil has a long cutting edge, there is a possibility that metal particles resulting from the cutting operation may land in the tube and give rise to electric breakdowns.

U.S. Pat. No. 4,002,941 discloses a very large number of profiled screening rings. Such screening rings are difficult to manufacture and nevertheless pass electrons in the corners of the display screen through a slot.

It is therefore the object of the invention to provide a colour display tube in which the disturbing lighting up of the display screen in the corners due to electrons passing beyond the cap is prevented in a very simple and inexpensive manner.

A colour display tube of the kind mentioned in the preamble is characterized according to the invention in that the magnetic screening cap at the edge of the end having the smallest diameter is provided with four radially extending resilient metal plates bent in the direction of the corner points of the display screen, which plates press against the electrically conductive inner coating of the cone.

An additional advantage of this construction is that the plates not only prevent unwanted electrons from reaching the screen but also constitute a good electrically conductive connection between the screening cap and the conductive coating on the inside of the cone. As a result of this, contact springs between the screening cap and the conductive coating may be omitted. Since the plates are situated so as to be much closer to the electron guns than the known screening means, they may be small and nevertheless screen a comparatively large area on the display screen.

The plates preferably consist of Cr-Ni steel in a thickness of approximately 0.05 mm. On their side with which they press against the inner coating the plates are adapted to the shape of the cone or are provided with a number of incisions so that said adaptation is automatically obtained.

Figure 2:
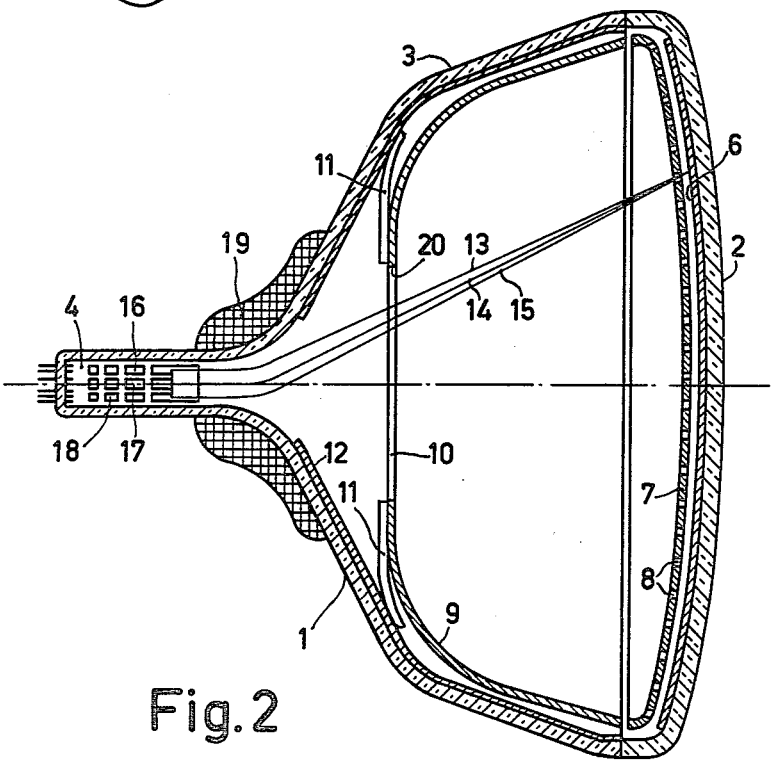
Figure 3:
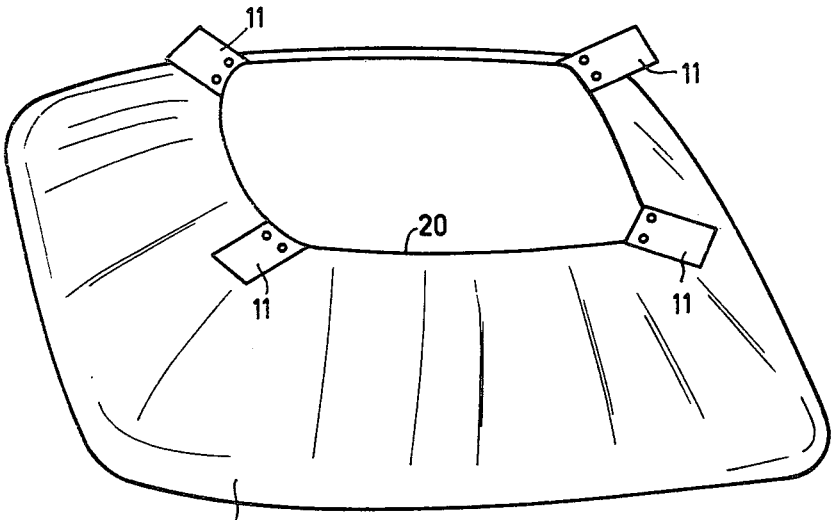
Figure 4:
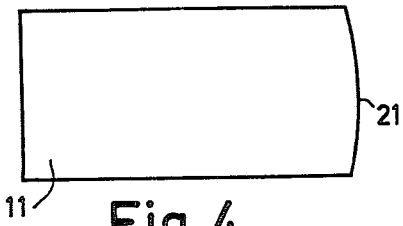
Figure 5:
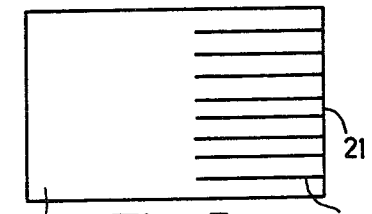

The invention will now be described in greater detail with reference to the drawings, in which FIG. 1 is a perspective view of a colour display tube according to the invention, FIG. 2 is a sectional view of a colour display tube according to the invention, FIG. 3 is a perspective view of a magnetic screening cap, and FIGS. 4 and 5 show embodiments of the plates.

FIG. 1 is a perspective view of a colour display tube according to the invention. The display tube is comprised of an evelope 1 consisting of a display window 2, a cone 3 and a neck 4 having connection pins 5. On the inside of the display window 2 a display screen 6 is provided (not visible) consisting of a large number of phosphor regions, luminescing in three different colours. Disposed in front of the display screen is a colour selection electrode 7 consisting of a metal plate having a very large number of circular or elongate apertures 8. (The colour selection electrode 7 is not visible either). From the colour selection electrode 7 the magnetic screening cap 9 in the cone 3 extends in the direction of the neck 4. The end of the screening cap having the smallest dimension has an aperture 10. The Cr-Ni steel plates 11 connected to the screening cap press against the conductive inner coating 12 (not visible) and intercept the undesired electrons.

FIG. 2 is a cross-sectional view of such a colour display tube. A system of three electron guns 16, 17 and 18 generating the electron beams 13, 14 and 15 is situated in the neck 4. The electron beams are deflected over the display screen 6 in two mutually perpendicular directions by means of the deflection coil system 19. The electron beams enclose a small angle with each other, the so-called colour selection angle, and consequently, after having passed through the apertures 8 in the colour selection electrode 7, each impinges only upon phosphor regions of one colour. In order to obtain a good filling of the picture, the electron beams are deflected to a greater extent than would actually be necessary (so-called overscan). The extra deflection is largest in the corners of the display screen so that the possibility that electrons pass between the screening cap and the conductive coating towards the display screen is largest at that region. According to the invention the electrons are intercepted by plates 11.

FIG. 3 is a perspective view of a screening cap 9. It is manufactured from sheet iron of 150 μm thickness and is blackened in an oxidizing atmosphere. The Ni-Cr steel plates 11 are secured to the edge 20 of the screening cap 9 by means of spotwelds. The plates have a length such that they press against the conductive coating 12 when the screening cap is mounted in the tube.

FIG. 4 shows one of the Ni-Cr steel plates. The end 21 is rounded off so that it follows the shape of the wall of the cone.

FIG. 5 shows another embodiment of a plate 11. The end 21 which presses against the conductive inner coating has a large number of incisions 22 so that it more easily follows the shape of the wall of the cone.

What is claimed is:

1. A colour display tube comprising an envelope having a rectangular display window, a cone having an electrically conductive inner coating, and a neck, a display screen on the inner surface of the display window, a colour selection electrode disposed in said envelope at some distance in front of the display screen, means to generate at least one electrode beam disposed in the neck and a magnetic screening cap which extends in the cone from the colour selection electrode towards the neck, the edge of the magnetic screening cap adjacent the neck being provided with four radially extending resilient metal plates bent in the direction of the corners of the display screen, which plates press against the electrically conductive inner coating of the cone.

2. A colour display tube as claimed in claim 1, wherein the plates are made from Cr-Ni steel.

3. A colour display tube as claimed in claim 1 or 2, wherein the side of the plates with which they press against the inner coating is provided with a number of incisions.

* * * * *

UNITED STATES PATENT OFFICE

CERTIFICATE OF CORRECTION

Patent No. 4,198,587 Dated April 15,1980

Inventor(s) MARTINUS C.M. VERHOEVEN et al

It is certified that error appears in the above-identified patent and that said Letters Patent are hereby corrected as shown below:

Col. 3 , line 3, Before "beam" delete "electrode" and insert -- electron--

Signed and Sealed this

*Thirteenth* Day of *January 1981*

[SEAL]

*Attest:*

SIDNEY A. DIAMOND

*Attesting Officer*

*Commissioner of Patents and Trademarks*